US010927835B2

(12) United States Patent
Penkal et al.

(10) Patent No.: US 10,927,835 B2
(45) Date of Patent: Feb. 23, 2021

(54) SCROLL COMPRESSOR WITH SCROLL BOLT CLAMP JOINT

(71) Applicant: Emerson Climate Technologies, Inc., Sidney, OH (US)

(72) Inventors: Bryan James Penkal, Troy, OH (US); Calvin W. Keeran, Piqua, OH (US); Chad M. Poeppelman, Fort Loramie, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 178 days.

(21) Appl. No.: 16/173,351

(22) Filed: Oct. 29, 2018

(65) Prior Publication Data

US 2019/0128263 A1 May 2, 2019

Related U.S. Application Data

(60) Provisional application No. 62/580,727, filed on Nov. 2, 2017.

(51) Int. Cl.
*F04C 18/02* (2006.01)

(52) U.S. Cl.
CPC ..... *F04C 18/0215* (2013.01); *F04C 18/0253* (2013.01); *F04C 2240/30* (2013.01); *F04C 2240/56* (2013.01); *F04C 2240/805* (2013.01)

(58) Field of Classification Search
CPC ..... F04C 18/0215; F04C 2240/56; F04C 2240/805
See application file for complete search history.

(56) References Cited

U.S. PATENT DOCUMENTS 5,102,316 A 4/1992 Caillat et al.
9,510,862 B2 * 12/2016 Montello ..... A61B 17/7001
9,752,578 B2 9/2017 Han et al.
(Continued)

FOREIGN PATENT DOCUMENTS

KR 1019950025264 A 9/1995
KR 2019960008506 U 3/1996
WO WO-9527143 A1 10/1995

OTHER PUBLICATIONS

International Search Report regarding International Application No. PCT/US2018/058748 dated Feb. 15, 2019.
(Continued)

*Primary Examiner* — Mary Davis
(74) *Attorney, Agent, or Firm* — Harness, Dickey & Pierce, P.L.C.

(57) ABSTRACT

A scroll compressor can include a housing, a rod member, and a nut. The housing can define a first bore. The non-orbiting scroll can include a flange. The flange can define a second bore. The rod member can have a first axial end that is coupled to the housing. The rod member can extend from the first bore and through the second bore to a second axial end of the rod member. The rod member can include at least one set of external threads. The at least one set of external threads can be disposed about the second axial end of the rod member. The nut can be threadably engaged with the second axial end of the rod member. The second bore can be disposed axially between the nut and the housing. The primary forces acting within the rod member are tensile forces, while torsional shear forces are minimized.

18 Claims, 3 Drawing Sheets

(56) References Cited

U.S. PATENT DOCUMENTS

| | | | | |
|---|---|---|---|---|
| 2005/0220648 | A1 | 10/2005 | Sato et al. | |
| 2008/0166252 | A1 | 7/2008 | Stover | |
| 2009/0257900 | A1 | 10/2009 | Beers et al. | |
| 2017/0002817 | A1 | 1/2017 | Stover | |
| 2017/0030393 | A1* | 2/2017 | Phua | F16B 35/04 |

OTHER PUBLICATIONS

Written Opinion of the ISA regarding International Application No. PCT/US2018/058748 dated Feb. 15, 2019.

Fastenal Industrial & Construction Supplies, "Technical Reference Guide." S7028, Rev. 9, https://www.fastenal.com/content/documents/FastenalTechnicalReferenceGuide.pdf (2005).

* cited by examiner

SCROLL COMPRESSOR WITH SCROLL BOLT CLAMP JOINT

CROSS-REFERENCE TO RELATED APPLICATIONS

This application claims the benefit of U.S. Provisional Application No. 62/580,727, filed on Nov. 2, 2017. The entire disclosure of the above application is incorporated herein by reference.

FIELD

The present disclosure relates to a compressor, and more specifically to a scroll compressor with a scroll bolt clamp joint.

BACKGROUND

This section provides background information related to the present disclosure and is not necessarily prior art.

Cooling systems, refrigeration systems, heat-pump systems, and other climate-control systems include a fluid circuit having a condenser, an evaporator, an expansion device disposed between the condenser and evaporator, and a compressor circulating a working fluid (e.g., refrigerant) between the condenser and the evaporator. Efficient and reliable operation of the compressor is desirable to ensure that the cooling, refrigeration, or heat-pump system in which the compressor is installed is capable of effectively and efficiently providing a cooling and/or heating effect on demand.

Typical scroll-type compressors have a non-orbiting scroll and an orbiting scroll that orbits relative to the non-orbiting scroll in order to compress the working fluid in pockets formed between the scrolls. The non-orbiting scroll is typically rotationally fixed to a main bearing housing by threaded fasteners. The fasteners typically have a hexagonal or other shaped head and a threaded shaft unitarily formed with the head. The shaft extends through a bushing disposed within an aperture in the non-orbiting scroll and is threaded into the main bearing housing. The head typically abuts one end of the bushing such that the bushing is clamped between the head and the main bearing housing in a manner that permits the non-orbiting scroll to move axially along the bushing. Typically, such fasteners are tightened to a specific torque specification or to yield of the fastener. While such a configuration has worked well for its intended use, the configuration can create a considerable amount of torsional or shear stress in the shaft of the fastener, as well as bending stress due to normal loading of the joint. The induced torsional stress adds to the bolt tensile stresses that facilitate desired clamping. Thus, there exists a need for a scroll compressor with an improved scroll clamping arrangement to minimize the torsional stress impact.

SUMMARY

This section provides a general summary of the disclosure, and is not a comprehensive disclosure of its full scope or all of its features.

According to one aspect, the present disclosure provides for a compressor including a housing, a first scroll, a second scroll, a rod member, and a nut. The housing can define a first bore. The first scroll can be supported by the housing for orbital motion relative to the housing and can include a first endplate having a first spiral wrap extending therefrom. The second scroll can be supported by the housing and can include a second endplate and a flange. The second endplate can have a second spiral wrap extending therefrom and can meshingly engage with the first spiral wrap to form a series of compression pockets. The flange can extend radially outwardly from the endplate and can define a second bore. The rod member can have a first axial end that is coupled to the housing. The rod member can extend from the first bore and through the second bore to a second axial end of the rod member. The rod member can include at least one set of external threads. The at least one set of external threads can be disposed about the second axial end of the rod member. The nut can be threadably engaged with the second axial end of the rod member. The second bore can be disposed axially between the nut and the housing.

In some configurations, the compressor can further include a bushing. The bushing can extend through the second bore and can abut the housing and the nut.

In some configurations, the second axial end of the rod member can define a recess having a predetermined shape configured to engage a mating predetermined shape of a driving tool.

In some configurations, the nut can define a third bore that partially extends axially through the nut. The second axial end of the rod member can extend into the third bore and be threadably engaged with the nut therein.

In some configurations, the nut can define a third bore that extends axially through the nut. The second axial end of the rod member can extend into the third bore and be threadably engaged with the nut therein.

In some configurations, the housing can define a set of first internal threads disposed within the first bore and the rod member can be threadably engaged with the first internal threads.

In some configurations, the at least one set of external threads can include a set of first external threads that extend from the first axial end to the second axial end. The first external threads can be threadably engaged with the first internal threads and the nut.

In some configurations, the at least one set of external threads can include a set of first external threads and a set of second external threads separate from the first external threads. The first external threads can be disposed about the first axial end of the rod member and threadably engaged with the first internal threads. The second external threads can be disposed about the second axial end of the rod member and threadably engaged with the nut.

In some configurations, the set of first internal threads can extend an axial distance that is less than a full depth of the first bore.

In some configurations, the housing can include a shoulder disposed within the first bore and extending radially inward of the set of first internal threads.

In some configurations, the compressor can further include a stop member. The stop member can be threadably engaged with the housing within the first bore and configured to engage the first axial end of the rod member to inhibit the rod member from being threaded into the first bore beyond a predetermined distance.

In some configurations, the housing can define a set of second internal threads disposed within the first bore. The second internal threads can have an opposite thread direction from the first internal threads.

In some configurations, the rod member can be non-rotatably coupled to the housing.

In some configurations, the first axial end of the rod member includes a head. The head can have a predetermined shape and the housing can define a recess having a mating predetermined shape. The head can be received in the recess and can matingly engage the recess to prevent rotation of the rod member relative to the housing.

In some configurations, the housing can be a main bearing housing and the first bore can be defined by an arm of the main bearing housing.

According to another aspect, the present disclosure provides for a compressor including a housing, a first scroll, a second scroll, a rod member, and a nut. The housing can include an arm that can define a first bore. The arm can include a set of first internal threads disposed within the first bore. The first scroll can be supported by the housing for orbital motion relative to the housing and can include a first endplate having a first spiral wrap extending therefrom. The second scroll can be supported by the housing and can include a second endplate and a flange. The second endplate can have a second spiral wrap extending therefrom and meshingly engaged with the first spiral wrap to form a series of compression pockets. The flange can extend radially outwardly from the second endplate and can define a second bore coaxial with the first bore. The rod member can include at least one set of external threads. A first axial end of the rod member can be threadably engaged to the first internal threads of the first bore. The rod member can extend from the first bore and through the second bore to a second axial end of the rod member. The nut can be threadably engaged with the second axial end of the rod member. The flange can be disposed axially between the nut and the arm of the housing.

In some configurations, the second axial end of the rod member defines a recess having a predetermined shape configured to engage a mating predetermined shape of a driving tool.

In some configurations, the arm of the housing can include a shoulder disposed within the first bore and extending radially inward of the set of first internal threads.

In some configurations, the nut can define a third bore that can extend axially through the nut. The second axial end of the rod member can extend into the third bore and be threadably engaged with the nut therein.

According to another aspect, the present disclosure provides for a compressor including a housing, a first scroll, a second scroll, a rod member, and a nut. The housing can include an arm that has a first surface and a second surface opposite the first surface. The arm can define a first bore that extends through the arm and is open through the first and second surfaces. The first scroll can be supported by the housing for orbital motion relative to the housing and can include a first endplate having a first spiral wrap extending therefrom. The second scroll can be supported by the housing and can include a second endplate and a flange. The second endplate can have a second spiral wrap extending therefrom and meshingly engaged with the first spiral wrap to form a series of compression pockets. The flange can extend radially outwardly from the endplate and can define a second bore coaxial with the first bore. The rod member can have a first axial end that is nonrotatably coupled to the arm. The rod member can extend from the first bore and through the second bore to a second axial end of the rod member. The rod member can include a set of external threads disposed about the second axial end of the rod member. The nut can be threadably engaged with external threads of the rod member. The arm can be disposed axially between the nut and the first surface of the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
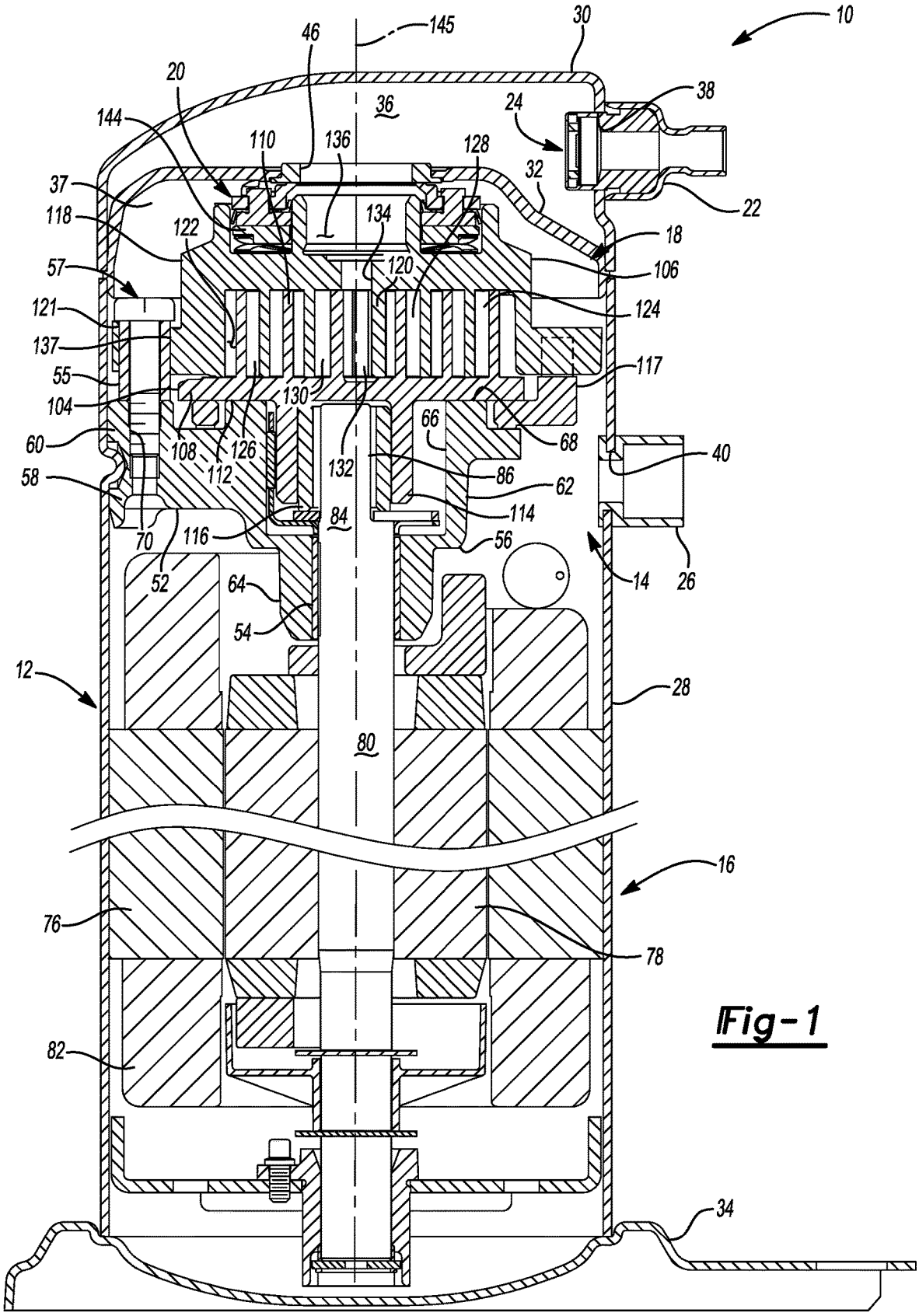
FIG. 1 is a cross-sectional view of a compressor in accordance with the principles of the present disclosure.

The following description is merely exemplary in nature and is not intended to limit the present disclosure, application or uses. It should be understood that throughout the drawings, corresponding reference numerals indicate like or corresponding parts and features.

The present teachings are suitable for incorporation in many types of different scroll and rotary compressors, including hermetic machines, open drive machines and non-hermetic machines. For exemplary purposes, a compressor 10 is shown as a hermetic scroll refrigerant-compressor of the low side type, i.e., where the motor and compressor are cooled by suction gas in the hermetic shell, as illustrated in the vertical section shown in FIG. 1.

With initial reference to FIG. 1, the compressor 10 may include a hermetic shell assembly 12, a main bearing housing assembly 14, a motor assembly 16, a compression mechanism 18, a seal assembly 20, a refrigerant discharge fitting 22, a discharge valve assembly 24, and a suction gas inlet fitting 26. The shell assembly 12 may house the main bearing housing assembly 14, the motor assembly 16, and the compression mechanism 18.

The shell assembly 12 may generally form a compressor housing and may include a cylindrical shell 28, an end cap 30 at the upper end thereof, a transversely extending partition 32, and a base 34 at a lower end thereof. The end cap 30 and the partition 32 may generally define a discharge chamber 36, while the cylindrical shell 28, the partition 32, and the base 34 may generally define a suction chamber 37. The discharge chamber 36 may generally form a discharge muffler for the compressor 10. The refrigerant discharge fitting 22 may be attached to the shell assembly 12 at the opening 38 in the end cap 30. The discharge valve assembly 24 may be located within the discharge fitting 22 and may generally prevent a reverse flow condition. The suction gas inlet fitting 26 may be attached to the shell assembly 12 at the opening 40, such that the suction gas inlet fitting 26 is in fluid communication with the suction chamber 37. The partition 32 may include a discharge passage 46 therethrough that provides communication between the compression mechanism 18 and the discharge chamber 36.

The main bearing housing assembly 14 may be affixed to the shell 28 at a plurality of points in any desirable manner, such as staking. The main bearing housing assembly 14 may include a main bearing housing 52, a first bearing 54 disposed therein, at least one bushing 55 (only one of which is shown), and at least one clamp joint assembly 57 (only one of which is shown). The main bearing housing 52 may include a central body portion 56 and an outer portion 58 that extends radially outward from the central body portion 56. In the example provided, the outer portion can include a series of arms 60 (only one of which is shown) that extend radially outwardly from the central body portion 56. The central body portion 56 may include first and second portions 62 and 64 having an opening 66 extending therethrough. The second portion 64 may house the first bearing 54 therein. The first portion 62 may define an annular flat thrust bearing surface 68 on an axial end surface thereof. The arms 60 can extend radially outward from the first portion 62. The arms 60 can contact the interior face of the cylindrical shell 28 and can be fixedly coupled thereto. Each of the arms 60 may include a bore 70 extending therethrough that is configured to receive a portion of a corresponding one of the clamp joint assemblies 57, as described in greater detail below.

The motor assembly 16 may generally include a motor stator 76, a rotor 78, and a drive shaft 80. Windings 82 may pass through the motor stator 76. The motor stator 76 may be press-fit into the shell 28 below the main bearing housing 52. The drive shaft 80 may be rotatably driven by the rotor 78. The rotor 78 may be press-fit on the drive shaft 80. The drive shaft 80 may include an eccentric crank pin 84 having a crank pin flat 86 thereon.

The compression mechanism 18 may generally include an orbiting scroll 104 and a non-orbiting scroll 106. The orbiting scroll 104 may include an endplate 108 having a spiral vane or wrap 110 on the upper surface thereof and an annular flat thrust surface 112 on the lower surface. The thrust surface 112 may interface with the annular flat thrust bearing surface 68 on the main bearing housing 52. A cylindrical hub 114 may project downwardly from the thrust surface 112 and may have a drive bushing 116 rotatably disposed therein. The drive bushing 116 may include an inner bore in which the crank pin 84 is drivingly disposed. The crank pin flat 86 may drivingly engage a flat surface in a portion of the inner bore of the drive bushing 116 to provide a radially compliant driving arrangement. An Oldham coupling 117 may be engaged with the orbiting and non-orbiting scrolls 104, 106 to prevent relative rotation therebetween.

The non-orbiting scroll 106 may include an endplate 118 having a spiral wrap 120 on a lower surface thereof and a series of radially outwardly extending flanged portions 121. The spiral wrap 120 may form a meshing engagement with the wrap 110 of the orbiting scroll 104, thereby creating compression pockets, including an inlet pocket 122, intermediate pockets 124, 126, 128, 130, and an outlet pocket 132. The non-orbiting scroll 106 may be axially displaceable relative to the main bearing housing assembly 14, the shell assembly 12, and the orbiting scroll 104. The non-orbiting scroll 106 may include a discharge passage 134 in communication with the outlet pocket 132 and an upwardly open recess 136. The upwardly open recess 136 may be in fluid communication with the discharge chamber 36 via the discharge passage 46 in the partition 32.

The flanged portions 121 may include openings 137 therethrough. The openings 137 can be coaxial with the bores 70 of the arms 60. Each opening 137 may receive one of the bushings 55 therein. The respective bushing 55 may receive a portion of one of the clamp joint assemblies 57. The clamp joint assemblies 57 may generally be engaged with the main bearing housing 52 and the bushings 55. The bushings 55 may generally form a guide for axial displacement of the non-orbiting scroll 106. The clamp joint assemblies 57 may additionally prevent rotation of the non-orbiting scroll 106 relative to the main bearing housing assembly 14. The clamp joint assemblies 57 are described in greater detail below.

The non-orbiting scroll 106 may include an annular recess in the upper surface thereof defined by parallel and coaxial inner and outer sidewalls. The seal assembly 20 may include a floating seal 144 located within the annular recess. The seal assembly 20 may be axially displaceable relative to the shell assembly 12 and/or the non-orbiting scroll 106 to provide for axial displacement (i.e., displacement parallel to an axis of rotation 145) of the non-orbiting scroll 106 while maintaining a sealed engagement with the partition 32 to isolate the discharge chamber 36 from the suction chamber 37. More specifically, in some configurations, pressure, and/or a biasing member within the annular recess may urge the seal assembly 20 into engagement with the partition 32, and the spiral wrap 120 of the non-orbiting scroll 106 into engagement with the endplate 108 of the orbiting scroll 104, during normal compressor operation.

Figure 2:
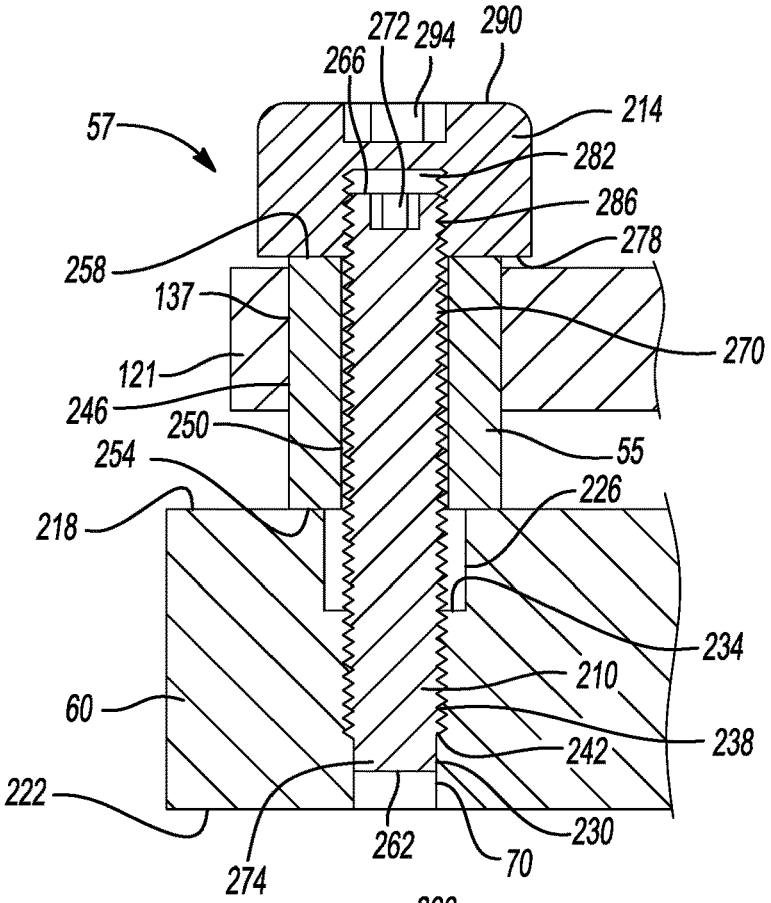
FIG. 2 is a cross-sectional view of a portion of the compressor of FIG. 1, illustrating a scroll bolt clamp joint of a first construction.

With additional reference to FIG. 2, a portion of one of the clamp joint assemblies 57 is illustrated in greater detail. The clamp joint assembly 57 can include a rod member 210 and a nut 214. The arm 60 can have a first surface 218 (i.e., the upper surface in the configuration shown) and a second surface 222 (i.e., the lower surface in the configuration shown) that is opposite the first surface 218. The bore 70 can be open through the first surface 218 and the second surface 222 to extend axially through the arm 60. In the example provided, the bore 70 has a first portion 226 open through the first surface 218 and a second portion 230 open through the second surface 222 that has a lesser inner diameter than the first portion 226, such that the intersection of the first and second portions 226, 230 forms a step 234. The arm 60 can define a set of first internal threads 238 (i.e., female threads) disposed coaxially within the interior of the second portion 230 of the bore 70. In the example provided, the first internal threads 238 extend axially from the step 234 to a location 242 between the step 234 and the second surface 222 (i.e., a predetermined distance from the step 234 that is less than the full distance to the second surface 222). The major diameter (e.g., greatest diameter) of the first internal threads 238 can be greater than the diameter of second portion 230 of the bore 70, such that the rod member 210 is prevented from being threaded into the bore 70 beyond the location 242 where the first internal threads 238 end.

In an alternative construction, not specifically shown, the bore 70 can maintain a single diameter between the first and second surfaces 218, 222 and the first internal threads 238 can start at the first surface 218 and extend a predetermined distance toward the second surface 222 or can extend fully to the second surface 222.

As discussed above, the bushing 55 can be disposed coaxially within the opening 137. The bushing 55 can be an annular shaped body having a smooth outer cylindrical surface 246 and a smooth inner cylindrical surface 250. The outer cylindrical surface 246 can be in sliding contact with the inner surface of the opening 137 of the flanged portion 121 of the non-orbiting scroll 106. The outer cylindrical surface 246 can have a diameter that is greater than the first portion 226 of the bore 70 such that a first end surface 254 of the bushing 55 abuts against the first surface 218 of the arm 60. The inner cylindrical surface 250 can have a diameter that is less than the diameter of the first portion 226 of the bore 70. The diameter of the inner cylindrical surface 250 can be greater than the outermost diameter of the rod member 210. A second end surface 258 of the bushing 55 can be opposite the first end surface 254 and can face away from the first surface 218 of the arm 60.

The rod member 210 can be a generally cylindrical body coaxial with the bore 70. The rod member 210 can extend axially from a first axial end 262 to a second axial end 266. The rod member 210 can have at least one set of external threads (i.e., male threads) disposed about the outer surface of the rod member 210. In the example provided, the rod member 210 includes a set of first external threads 270 that extends from the first axial end 262 to the second axial end 266.

In an alternative construction, not specifically shown, the rod member 210 can include a set of first external threads disposed about the first axial end 262 and a set of second external threads disposed about the second axial end 266 that are spaced apart by a non-threaded portion of the rod member 210.

In the example provided, the second axial end 266 can include a recess 272 that is coaxial with the rod member 210 and has a predetermined shape configured to accept a tool (not shown), such as a hex bit, torx bit, star bit, or other tool configured to rotate the rod member 210. In the example provided, the first axial end 262 also includes a non-threaded shank portion 274 that extends axially beyond the first external threads 270. The shank portion 274 can have an outermost diameter that is less than the diameter of the bore 70 such that the shank portion 274 can extend a predetermined distance beyond the location 242 where the first internal threads 238 end. In an alternative construction, not specifically shown, the first axial end 262 can be such that it does not include the shank portion 274 and the first external threads 270 end at the terminal end of the first axial end 262.

The nut 214 can be coaxial with the rod member 210 and can have a first end face 278 that can oppose and abut the second end surface 258 of the bushing 55. The nut 214 can extend radially outward of the outer cylindrical surface 246 of the bushing 55, such that contact between the nut 214 and the flanged portion 121 can limit axial movement of the flanged portion 121 in the direction away from the arm 60. In the example provided, the nut 214 is a cylindrical shape and has a bore 282 coaxial with the bore 70 and open at the first end face 278. In the example provided, the bore 282 partially extends axially through the nut 214 (i.e., does not extend fully through the nut 214). The bore 282 can have a set of second internal threads 286 (i.e., female threads) disposed within the bore 282 and configured to threadably engage the first external threads 270 of the rod member 210.

A second end face 290 of the nut 214 can be opposite the first end face 278 and can face generally away from the first surface 218 of the arm 60. In the example provided, the second end face 290 of the nut 214 can include a recess 294 that is coaxial with the bore 282 and has a predetermined shape configured to accept a tool (not shown), such as a hex bit, torx bit, star bit, or other tool configured to rotate the nut 214. The recess 294 can be open at the second end face 290 but not open to the bore 282.

In an alternative construction, not specifically shown, the nut can have an overall predetermined shape (e.g., hexagonal) configured such that a tool (e.g., wrench or socket) can matingly engage the radially outermost surfaces of the nut 214 to rotate the nut 214 instead of, or in addition to, the recess 294.

Thus, the clamp joint assembly 57 can be assembled in the following manner to axially retain the non-orbiting scroll 106. The rod member 210 can be inserted through the bushing 55 (e.g., slid through), and thus through the opening 137, and then threaded into the bore 70 until the rod member 210 is a desired distance into the bore 70. The desired distance can be such that the first external threads 270 bottom out (i.e., reach the location 242 where the first internal threads 238 end). When the rod member 210 is the desired distance into the bore 70, the second axial end 266 of the rod member 210 can protrude axially outward through the second end surface 258 of the bushing 55. The nut 214 can be threaded onto the second axial end 266 of the rod member 210 until it contacts the bushing 55. The nut 214 can be tightened thereon to a desired torque value.

Since the rod member 210 is separate from the nut 214, the primary forces acting within the rod member 210 when the nut 214 is tightened are tensile forces acting in the axial direction due to friction in the threads, and torsional shear forces in the rod member 210 are minimized. This new configuration also alleviates bending stress that the fastener sees during loading of the joint.

Figure 3:
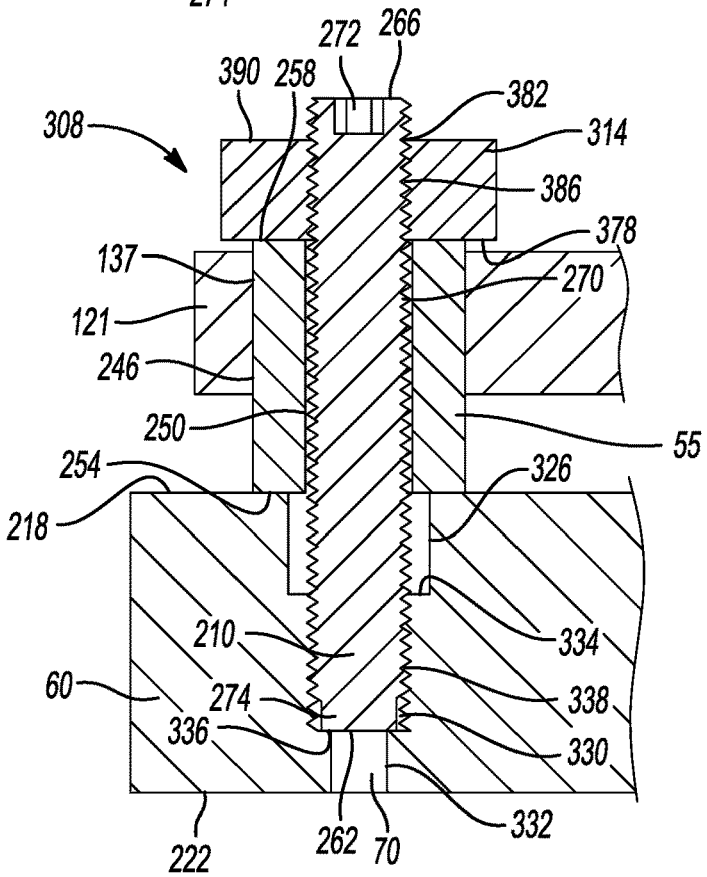
FIG. 3 is cross-sectional view similar to FIG. 2, illustrating a scroll bolt clamp joint of a second construction.

With additional reference to FIG. 3, a clamp joint assembly 308 of a second construction is illustrated. The clamp joint assembly 308 can include the rod member 210 and a nut 314 that can be similar to the clamp joint assembly 57 (FIG. 2) except as otherwise shown or described herein. In the example provided, the bore 70 includes a first portion 326, a second portion 330, and a third portion 332. The first portion 326 can be similar to the first portion 226 (FIG. 2), and can be open through the first surface 218. The second portion 330 can be similar to the second portion 230 (FIG. 2) except as otherwise shown or described herein. The second portion 330 can be axially between the first portion 326 and the third portion 332. The third portion 332 can be coaxial with the first portion 326 and the second portion 330 and can be open through the second surface 222. The second portion 330 can have a lesser inner diameter than the first portion 326, such that the intersection of the first and second portions 326, 330 forms a step 334. The third portion 332 can have a lesser inner diameter than the second portion 330, such that the intersection of the second and third portions 330, 332 forms a shoulder 336.

The arm 60 can define a set of first internal threads 338 (i.e., female threads) disposed coaxially within the interior of the second portion 330 of the bore 70. In the example provided, the first internal threads 338 extend axially from the step 334 to a location between the step 334 and the second surface 222 (i.e., a predetermined distance from the step 334 that is less than or equal to the full distance to the shoulder 336). The minimum diameter of the shank portion 274 of the first axial end 262 of the rod member 210 can be greater than the diameter of the third portion 332 of the bore 70, such that the rod member 210 is prevented from being threaded into the bore 70 beyond the shoulder 336 where the shank portion 274 can abut the shoulder 336. While specifically shown with the clamp joint assembly 308 of FIG. 3, the bore 70 and shoulder 336 can be used with the clamp joint assembly 57 of FIG. 2. Similarly, the bore 70 shown and described with reference to FIG. 2 can be used with the clamp joint assembly 308 of FIG. 3. In an alternative construction, not specifically shown, the third portion 332 can be closed such that the bore 70 does not extend through the second surface 222.

In the example provided, the nut 314 can be coaxial with the rod member 210 and can have a first end face 378 that can oppose and abut the second end surface 258 of the bushing 55. The nut 314 can extend radially outward of the outer cylindrical surface 246 of the bushing 55, such that contact between the nut 314 and the flanged portion 121 can limit axial movement of the flanged portion 121 in the direction away from the arm 60. In the example provided, the nut 314 can have an overall predetermined shape (e.g., hexagonal) configured such that a tool (e.g., wrench or socket) can matingly engage the radially outermost surfaces of the nut 314 to rotate the nut 314 about the rod member 210. The nut 314 can have a bore 382 that is coaxial with the bore 70 and open at the first end face 378. The bore 382 can have a set of second internal threads 386 (i.e., female threads) disposed within the bore 382 and configured to threadably engage the first external threads 270 of the rod member 210. The bore 382 and internal threads 386 can extend through the nut 314 to also be open at a second end face 390 of the nut 314 that is opposite the first end face 378 and generally faces away from the first surface 218 of the arm 60.

Thus, the clamp joint assembly 308 can be assembled in the following manner to axially retain the non-orbiting scroll 106. The rod member 210 can be inserted through the bushing 55 (e.g., slid through), and thus through the opening 137, and then threaded into the bore 70 until the rod member 210 is a desired distance into the bore 70. The desired distance can be such that the shank portion 274 abuts the shoulder 336. When the rod member 210 is the desired distance into the bore 70, the second axial end 266 of the rod member 210 can protrude axially outward through the second end surface 258 of the bushing 55. The nut 314 can be threaded onto the second axial end 266 of the rod member 210 until it contacts the bushing 55. A tool (not shown) can continue to hold the rod member 210 rotationally stationary (e.g., via the recess 272) while the tool, or another tool (not shown), rotates the nut 314 about the rod member 210 to tighten the nut 314 on the rod member 210 to a desired torque value.

Since the rod member 210 is separate from the nut 314 and the rod member is held rotationally fixed during tightening of the nut 314, the primary forces acting within the rod member 210 when the nut 314 is tightened are tensile forces acting in the axial direction due to friction in the threads, and torsional shear forces in the rod member 210 are minimized. The shoulder 336 can also ensure that the rod member 210 is inserted to the desired distance.

Figure 4:
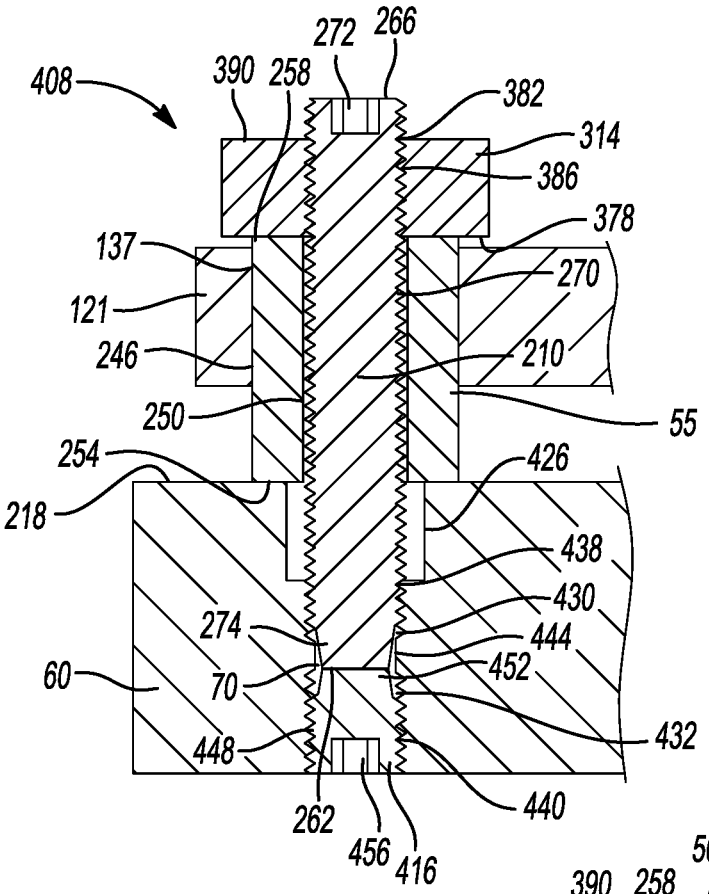
FIG. 4 is cross-sectional view similar to FIG. 2, illustrating a scroll bolt clamp joint of a third construction.

With additional reference to FIG. 4, a clamp joint assembly 408 of a third construction is illustrated. The clamp joint assembly 408 can be similar to the clamp joint assembly 57 (FIG. 2) or the clamp joint assembly 308 (FIG. 3), except as otherwise shown or described herein. In the example provided, the clamp joint assembly 408 can also include a stop member 416. While illustrated with the nut 314 (e.g., as shown and described with reference to FIG. 3), the nut 214 (FIG. 2) can be used. In the example provided, the bore 70 includes a first portion 426, a second portion 430, and a third portion 432. The first portion 426 can be similar to the first portion 226 (FIG. 2), and can be open through the first surface 218. The second portion 430 can be similar to the second portion 230 (FIG. 2) except as otherwise shown or described herein and can include internal threads 438. The third portion 432 can be coaxial with the second portion 430 and can include a set of internal threads 440 (i.e., female threads). The second portion 430 can be axially between the first and third portions 426, 432. The third portion 432 can be coaxial with the first portion 426 and the second portion 430 and can be open through the second surface 222.

The internal threads 440 of the third portion 432 can be separated from the internal threads of the second portion 430 by a non-threaded region 444. In the example provided, the internal threads 440 of the third portion 432 can be threaded in an opposite helical manner than the internal threads 438 of the second portion 430. For example, the internal threads 438 of the second portion 430 can be right-handed threads, while the internal threads 440 of the third portion 432 can be left-handed threads. Alternatively, the internal threads 438 of the second portion 430 can be left-handed threads, while the internal threads 440 of the third portion 432 can be right-handed threads. Alternatively, the internal threads 438 of the second portion 430 and the internal threads 440 of the third portion 432 can both be left-handed threads or right-handed threads. In an alternative construction, not specifically shown, the internal threads 440 of the third portion 432 can be a continuation of the internal threads of the second portion 430, such that the bore 70 does not include the non-threaded region 444.

The stop member 416 can be a generally cylindrical shaped body coaxial with the bore 70. The stop member 416 can have a set of external threads 448 disposed about the radially outermost surface of the stop member 416 that can threadably engage the internal threads 440 of the third portion 432. One axial end of the stop member 416 can have a shank portion 452 that can be non-threaded and extend axially beyond the external threads 448. The shank portion 452 can be a diameter that is less than the minor diameter (e.g., smallest diameter) of the internal threads 438, 440 and the non-threaded portion of the bore 70 therebetween. The shank portion 452 can be configured to abut the shank portion 274 of the rod member 210 within the bore 70. The opposite axial end of the stop member 416 can include a recess 456 of a predetermined shape (e.g., hexagonal, torx, or star) configured to receive a tool (not shown) having a mating shape to turn the stop member 416 in the bore 70.

Thus, the clamp joint assembly 408 can be assembled in the following manner to axially retain the non-orbiting scroll 106. The stop member 416 can be threaded into the third portion 432 of the bore 70 to a desired distance from the first surface 218. The rod member 210 can be inserted through the bushing 55 (e.g., slid through), and thus through the opening 137, and then threaded into the bore 70 until the rod member 210 is a desired distance into the bore 70. The desired distance can be such that the shank portion 274 abuts the shank portion 452 of the stop member 416. When the rod member 210 is the desired distance into the bore 70, the second axial end 266 of the rod member 210 can protrude axially outward through the second end surface 258 of the bushing 55. The nut 314 can be threaded onto the second axial end 266 of the rod member 210 until it contacts the bushing 55. A tool (not shown) can continue to hold the rod member 210 rotationally stationary (e.g., via the recess 272) while the tool, or another tool (not shown), rotates the nut 314 about the rod member 210 to tighten the nut 314 on the rod member 210 to a desired torque value. Since the stop member 416 is threaded into the bore 70, the location at which the rod member 210 bottoms out on the stop member can be adjusted.

Since the rod member 210 is separate from the nut 314 and the rod member is held rotationally fixed during tightening of the nut 314, the primary forces acting within the rod member 210 when the nut 314 is tightened are tensile forces acting in the axial direction due to friction in the threads, and torsional shear forces in the rod member 210 are minimized.

The stop member 416 can also ensure that the rod member 210 is inserted to the desired distance. In the example provided, the stop member 416 and the rod member 210 can have opposite thread directions (e.g., left or right handed threads) such that after the rod member 210 contacts the stop member 416, further tightening of the rod member 210 will not turn the stop member 416 in a rotational direction that would back the stop member 416 out of the bore 70.

Figure 5:
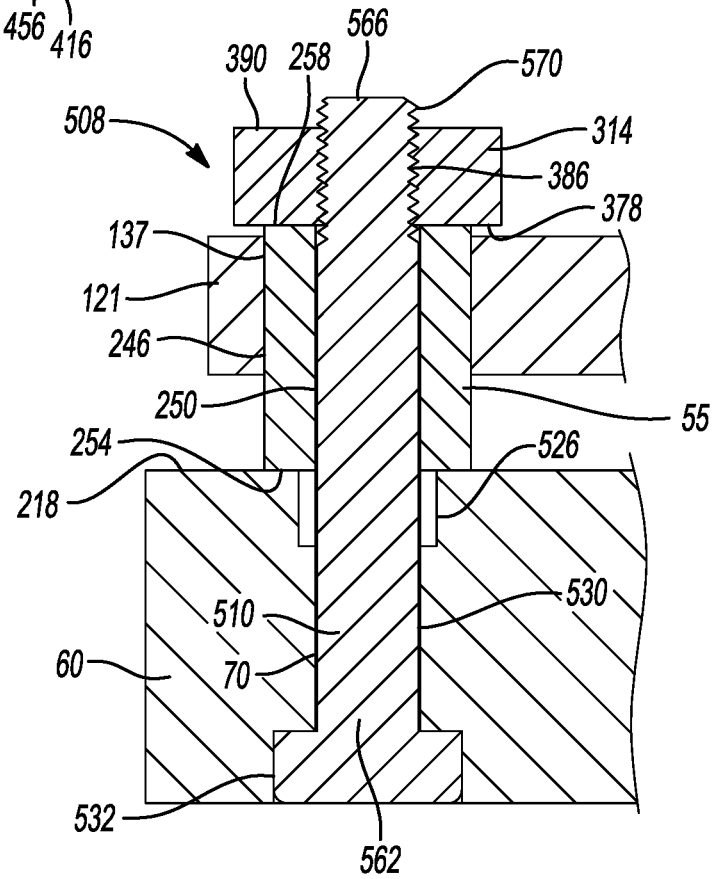
FIG. 5 is cross-sectional view similar to FIG. 2, illustrating a scroll bolt clamp joint of a fourth construction.

With additional reference to FIG. 5, a clamp joint assembly 508 of a fourth construction is illustrated. The clamp joint assembly 508 can be similar to the clamp joint assembly 57 (FIG. 2) or the clamp joint assembly 308 (FIG. 3), except as otherwise shown or described herein. In the example provided, the clamp joint assembly 508 can include a rod member 510 and the nut 314. While shown with the nut 314, the nut 214 (FIG. 2) can also be used.

The rod member 510 can have a first axial end 562 and a second axial end 566. In the example provided, the bore 70 can be smooth (i.e., without internal threads). In the example provided, the bore 70 can include a first portion 526, a second portion 530, and a third portion 532. The first portion 526 can be similar to the first portion 226 (FIG. 2), and can have a diameter that is greater than the diameter of the second portion 530. The second portion 530 can extend axially from the first portion 526 to the third portion 532. The third portion 532 can be open through the second surface 222 and configured to non-rotatably engage the first axial end 562 of the rod member 510.

In the example provided, the third portion 532 can have a predetermined shape (e.g., hexagonal, or a plurality of radially outward extending splines) that can be configured to mate with the first axial end 562 of the rod member 510, which can include a corresponding predetermined shape, in order to prevent rotation of the rod member 510 relative to the arm 60. In the example provided, the first axial end 562 of the rod member 510 is a hexagonal head that extends radially outward of the first axial end 562. The first axial end 562 can be press-fit into the bore 70 to inhibit the rod member 510 from falling out of the bore 70 during assembly. The first axial end 562 of the rod member 510 can include a set of first external threads 570 that can extend axially outward of the bushing 55 and can threadably mate with the internal threads of the nut 314.

Thus, the clamp joint assembly 508 can be assembled in the following manner to axially retain the non-orbiting scroll 106. The rod member 510 can be inserted through the bore 70 from the second surface 222, then through the bushing 55 (e.g., slid through), and thus through the opening 137, until the rod member 510 is a desired distance into the bore 70. The desired distance can be such that the rod member 510 cannot be inserted further into the bore 70. When the rod member 510 is the desired distance into the bore 70, the second axial end 566 of the rod member 510 can protrude axially outward through the second end surface 258 of the bushing 55. The nut 314 can be threaded onto the second axial end 566 of the rod member 510 until it contacts the bushing 55. A tool (not shown) can rotate the nut 314 about the rod member 510 to tighten the nut 314 on the rod member 510 to a desired torque value.

Since the rod member 510 is separate from the nut 314 and the rod member is held rotationally fixed during tightening of the nut 314 (e.g., via the predetermined shape of the first axial end 562), the primary forces acting within the rod member 510 when the nut 314 is tightened are tensile forces acting in the axial direction due to friction in the threads, and torsional shear forces in the rod member 510 are minimized.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:

a housing defining a first bore;

a first scroll supported by said housing for orbital motion relative to said housing and including a first endplate having a first spiral wrap extending therefrom;

a second scroll supported by said housing and including a second endplate and a flange, said second endplate having a second spiral wrap extending therefrom and meshingly engaged with said first spiral wrap to form a series of compression pockets, said flange extending radially outwardly from said second endplate and defining a second bore;

a rod member having a first axial end that is coupled to said housing, said rod member extending from said first bore and through said second bore to a second axial end of said rod member, said rod member including at least one set of external threads, said at least one set of external threads being disposed about said second axial end of said rod member; and a nut threadably engaged with said second axial end of said rod member, said second bore being disposed axially between said nut and said housing, wherein said second axial end of said rod member defines a recess having a predetermined shape configured to engage a mating predetermined shape of a driving tool.

2. The compressor of claim 1, further comprising a bushing, said bushing extending through said second bore and abutting said housing and said nut.

3. The compressor of claim 1, wherein said nut defines a third bore that partially extends axially through said nut, said second axial end of said rod member extending into said third bore and being threadably engaged with said nut therein.

4. The compressor of claim 1, wherein said nut defines a third bore that extends axially through said nut, said second axial end of said rod member extending into said third bore and being threadably engaged with said nut therein.

5. The compressor of claim 1, wherein said housing defines a set of first internal threads disposed within said first bore and said rod member is threadably engaged with said first internal threads.

6. The compressor of claim 5, wherein said at least one set of external threads includes a set of first external threads that extend from said first axial end to said second axial end, said first external threads being threadably engaged with said first internal threads and said nut.

7. The compressor of claim 5, wherein said at least one set of external threads includes a set of first external threads and a set of second external threads separate from said first external threads, said first external threads being disposed about said first axial end of said rod member and threadably engaged with said first internal threads, said second external threads being disposed about said second axial end of said rod member and threadably engaged with said nut.

8. The compressor of claim 5, wherein said set of first internal threads extend an axial distance that is less than a full depth of said first bore.

9. The compressor of claim 5, wherein said housing includes a shoulder disposed within said first bore and extending radially inward of said set of first internal threads.

10. The compressor of claim 5, further comprising a stop member, wherein said stop member is threadably engaged with said housing within said first bore and configured to engage said first axial end of said rod member to inhibit said rod member from being threaded into said first bore beyond a predetermined distance.

11. The compressor of claim 10, wherein said housing defines a set of second internal threads disposed within said first bore, said second internal threads having an opposite thread direction from said first internal threads.

12. The compressor of claim 1, wherein said housing is a main bearing housing and said first bore is defined by an arm of said main bearing housing.

13. The compressor of claim 1, wherein said nut defines a recess having a predetermined shape configured to engage a mating predetermined shape of a driving tool.

14. A compressor comprising:

a housing including an arm that defines a first bore, said arm including a set of first internal threads disposed within said first bore;

a first scroll supported by said housing for orbital motion relative to said housing and including a first endplate having a first spiral wrap extending therefrom;

a second scroll supported by said housing and including a second endplate and a flange, said second endplate having a second spiral wrap extending therefrom and meshingly engaged with said first spiral wrap to form a series of compression pockets, said flange extending radially outwardly from said second endplate and defining a second bore coaxial with said first bore;

a rod member including at least one set of external threads, a first axial end of said rod member being threadably engaged to said first internal threads of said first bore, said rod member extending from said first bore and through said second bore to a second axial end of said rod member; and a nut threadably engaged with said second axial end of said rod member, said flange being disposed axially between said nut and said arm of said housing.

15. The compressor of claim 14, wherein said second axial end of said rod member defines a recess having a predetermined shape configured to engage a mating predetermined shape of a driving tool.

16. The compressor of claim 14, wherein said arm of said housing includes a shoulder disposed within said first bore and extending radially inward of said set of first internal threads.

17. The compressor of claim 14, wherein said nut defines a third bore that extends axially through said nut, said second axial end of said rod member extending into said third bore and being threadably engaged with said nut therein.

18. A compressor comprising:

a housing including an arm that has a first surface and a second surface opposite said first surface, said arm defining a first bore that extends through said arm and is open through said first and second surfaces;

a first scroll supported by said housing for orbital motion relative to said housing and including a first endplate having a first spiral wrap extending therefrom;

a second scroll supported by said housing and including a second endplate and a flange, said second endplate having a second spiral wrap extending therefrom and meshingly engaged with said first spiral wrap to form a series of compression pockets, said flange extending radially outwardly from said second endplate and defining a second bore coaxial with said first bore;

a rod member having a first axial end that is nonrotatably coupled to said arm, said rod member extending from said first bore and through said second bore to a second axial end of said rod member, said rod member including a set of external threads disposed about said second axial end of said rod member; and a nut threadably engaged with external threads of said rod member, said arm being disposed axially between said nut and said first surface of said housing, wherein said second axial end of said rod member defines a recess having a predetermined shape configured to engage a mating predetermined shape of a driving tool.

* * * * *